US007638478B2

(12) United States Patent
Dodd et al.

(10) Patent No.: US 7,638,478 B2
(45) Date of Patent: Dec. 29, 2009

(54) PROCESS FOR PREPARING A TEXTILE TREATMENT AUXILIARY COMPOSITION AND A PROCESS FOR PREPARING A COMPOSITION FOR THE LAUNDERING AND TREATMENT OF FABRIC

(75) Inventors: Malcolm McClaren Dodd, Tyne & Wear (GB); Edward Sayers, Tyne and Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 409 days.

(21) Appl. No.: 11/499,998

(22) Filed: Aug. 7, 2006

(65) Prior Publication Data

US 2007/0028391 A1 Feb. 8, 2007

(30) Foreign Application Priority Data

Aug. 5, 2005 (EP) ..... 05254889

(51) Int. Cl.
*C11D 3/60* (2006.01)
*C11D 11/00* (2006.01)

(52) U.S. Cl. ..... 510/513; 510/417; 510/444; 510/457; 510/466; 510/507; 510/515; 510/535

(58) Field of Classification Search ..... 8/115.51; 510/437–507, 417, 513, 515, 535
See application file for complete search history.

(56) References Cited

U.S. PATENT DOCUMENTS

| | | | | |
|---|---|---|---|---|
| 4,062,647 | A | 12/1977 | Storm et al. | |
| 4,419,250 | A | 12/1983 | Allen et al. | |
| 4,421,657 | A | 12/1983 | Allen et al. | |
| 4,482,477 | A | 11/1984 | Allen et al. | |
| 4,585,563 | A | 4/1986 | Busch et al. | |
| 4,885,101 | A | 12/1989 | Tai | |
| 5,277,968 | A | 1/1994 | Canivenc | |
| 6,656,901 | B2 | 12/2003 | Moorfield et al. | |
| 7,304,024 | B2 * | 12/2007 | Blyth et al. | 510/371 |
| 2003/0139309 | A1 | 7/2003 | Brockett et al. | |
| 2003/0216278 | A1 * | 11/2003 | Depoot et al. | 510/421 |
| 2005/0170995 | A1 | 8/2005 | Blyth et al. | |
| 2005/0170996 | A1 | 8/2005 | Blyth et al. | |
| 2005/0170997 | A1 | 8/2005 | Blyth et al. | |
| 2007/0028392 | A1 | 2/2007 | Dodd | |
| 2007/0028393 | A1 | 2/2007 | Blyth et al. | |

FOREIGN PATENT DOCUMENTS

| | | | |
|---|---|---|---|
| EP | 0 163 352 | A2 | 12/1985 |
| EP | 0 299 575 | A1 | 1/1989 |
| EP | 0 381 487 | A1 | 8/1990 |
| EP | 0 483 411 | A1 | 5/1992 |
| EP | 1 561 802 | A1 | 8/2005 |
| GB | 2 138 037 | A | 10/1984 |
| WO | WO 92/07927 | A1 | 5/1992 |
| WO | WO 02/092748 | A1 | 11/2002 |

OTHER PUBLICATIONS

PCT International Search Report, 4 Pages, Mailed Jan. 25, 2007.

* cited by examiner

*Primary Examiner*—Lorna M Douyon
*Assistant Examiner*—Tri V Nguyen
(74) *Attorney, Agent, or Firm*—Mark A. Charles; Ronald Terk Sia

(57) ABSTRACT

The present invention relates to a process for preparing a textile treatment auxiliary composition in particulate form, wherein the composition comprises anionic surfactant, clay and silicone, and wherein the process comprises the steps of: (i) contacting the silicone with water and a first anionic surfactant, to form an aqueous silicone mixture in emulsified form; and (ii) thereafter contacting the aqueous silicone mixture with the clay, a second anionic surfactant and optionally additional water to form a mixture of clay and silicone; (iii) further mixing the mixture of clay and silicone; and (iv) optionally drying and optionally cooling the mixture formed in step (iii).

10 Claims, No Drawings

PROCESS FOR PREPARING A TEXTILE TREATMENT AUXILIARY COMPOSITION AND A PROCESS FOR PREPARING A COMPOSITION FOR THE LAUNDERING AND TREATMENT OF FABRIC

TECHNICAL FIELD

The present invention relates to a process for preparing a particulate textile treatment auxiliary composition that is capable of imparting a fabric-softness benefit to a textile. The composition comprises anionic surfactant, clay and silicone. The composition is particularly suitable as an auxiliary in the laundering of fabrics.

The present invention also relates to a process for preparing a composition for the laundering and treatment of fabric. The composition is typically a laundry detergent composition.

BACKGROUND

Laundry detergent compositions that both clean and soften fabric during a laundering process are known and have been developed and sold by laundry detergent manufacturers for many years. Typically, these laundry detergent compositions comprise components that are capable of providing a fabric-softening benefit to the laundered fabric; these fabric-softening components include clays and silicones.

The incorporation of clay into laundry detergent compositions to impart a fabric-softening benefit to the laundered fabric is described in the following references. A granular, built laundry detergent composition comprising a smectite clay that is capable of both cleaning and softening a fabric during a laundering process is described in U.S. Pat. No. 4,062,647 (Storm, T. D., and Nirschl, J. P.; The Procter & Gamble Company). A heavy duty fabric-softening detergent comprising bentonite clay agglomerates is described in GB 2 138 037 (Allen, E., Coutureau, M., and Dillarstone, A.; Colgate-Palmolive Company). Laundry detergent compositions containing fabric-softening clays of between 150 and 2,000 microns in size are described in U.S. Pat. No. 4,885,101 (Tai, H. T.; Lever Brothers Company).

The fabric-softening performance of clay-containing laundry detergent compositions is improved by the incorporation of a flocculating aid to the clay-containing laundry detergent composition. For example, a detergent composition comprising a smectite type clay and a polymeric clay-flocculating agent is described in EP 0 299 575 (Raemdonck, H., and Busch, A.; The Procter & Gamble Company).

The use of silicones to provide a fabric-softening benefit to laundered fabric during a laundering process is also known. U.S. Pat. No. 4,585,563 (Busch, A., and Kosmas, S.; The Procter & Gamble Company) describes that specific organo-functional polydialkylsiloxanes can advantageously be incorporated in granular detergents to provide remarkable benefits inclusive of through-the-wash softening and further textile handling improvements. U.S. Pat. No. 5,277,968 (Canivenc, E.; Rhone-Poulenc Chemie) describes a process for the conditioning of textile substrates to allegedly impart a pleasant feel and good hydrophobicity thereto, comprising treating such textile substances with an effective conditioning amount of a specific polydiorganosiloxane.

Detergent Manufacturers have attempted to incorporate both clay and silicone in the same laundry detergent composition. For example, siliconates were incorporated in clay-containing compositions to allegedly improve their dispensing performance. U.S. Pat. No. 4,419,250 (Allen, E., Dillarstone, R., and Reul, J. A.; Colgate-Palmolive Company) describes agglomerated bentonite particles that comprise a salt of a lower alkyl siliconic acid and/or a polymerization product(s) thereof. U.S. Pat. No. 4,421,657 (Allen, E., Dillarstone, R., and Reul, J. A.; Colgate-Palmolive Company) describes a particulate heavy-duty laundering and textile-softening composition comprising bentonite clay and a siliconate. U.S. Pat. No. 4,482,477 (Allen, E., Dillarstone, R., and Reul, J. A.; Colgate-Palmolive Company) describes a particulate built synthetic organic detergent composition which includes a dispensing assisting proportion of a siliconate and preferably bentonite as a fabric-softening agent. In another example, EP 0 163 352 (York, D. W.; The Procter & Gamble Company) describes the incorporation of silicone into a clay-containing laundry detergent composition in an attempt to control the excessive suds that are generated by the clay-containing laundry detergent composition during the laundering process. EP 0 381 487 (Biggin, I. S., and Cartwright, P. S.; BP Chemicals Limited) describes an aqueous based liquid detergent formulation comprising clay that is pre-treated with a barrier material such as a polysiloxane.

Detergent manufacturers have also attempted to incorporate a silicone, clay and a flocculant in a laundry detergent composition. For example, a fabric treatment composition comprising substituted polysiloxanes, softening clay and a clay flocculant is described in WO92/07927 (Marteleur, C. A. A. V. J., and Convents, A. C.; The Procter & Gamble Company).

More recently, fabric care compositions comprising an organophilic clay and functionalised oil are described in U.S. Pat. No. 6,656,901 B2 (Moorfield, D., and Whilton, N.; Unilever Home & Personal Care USA division of Conopco, Inc.). WO02/092748 (Instone, T. et al; Unilever PLC) describes a granular composition comprising an intimate blend of a non-ionic surfactant and a water-insoluble liquid, which may a silicone, and a granular carrier material, which may be a clay. WO03/055966 (Cocardo, D. M., et al; Hindustain Lever Limited) describes a fabric care composition comprising a solid carrier, which may be a clay, and an anti-wrinkle agent, which may be a silicone.

However, particles that comprise silicone and clay are very soft and have a poor flowability profile. There is a need to improve the strength of particles that comprise both clay and silicone in order to improve their flowability profile whilst not unduly affecting their fabric-softening performance.

SUMMARY

The present invention overcomes the above mentioned problem by providing a process for preparing a textile treatment auxiliary composition in particulate form, wherein the auxiliary composition comprises anionic surfactant, clay and silicone, and wherein the process comprises the steps of: (i) contacting the silicone with water and a first anionic surfactant, to form an aqueous silicone mixture in emulsified form; and (ii) contacting the aqueous silicone mixture with the clay, a second anionic surfactant and optionally additional water to form a mixture of clay and silicone; (iii) further mixing the mixture of clay and silicone; and (iv) optionally drying and/or cooling the mixture formed in step (iii).

The composition can be used per se in the treatment of textiles or can be used as an auxiliary in a laundry detergent or additive product. Accordingly, the textile treatment auxiliary composition is sometimes referred to herein as "the auxiliary composition".

DESCRIPTION

Process for Preparing the Textile Treatment Auxiliary Composition

The process for preparing the auxiliary composition comprises the steps of: (i) contacting a silicone with water and a first anionic surfactant, to form an aqueous silicone mixture in emulsified form; (ii) contacting the aqueous silicone mixture with a clay, a second anionic surfactant and optionally additional water to form a mixture of clay and silicone; (iii) further mixing the mixture of clay and silicone; and (iv) optionally drying and/or cooling the mixture formed in step (iii) to form an auxiliary composition.

Preferably step (i) is carried out in a mixer suitable for forming aqueous silicone emulsions. Step (i) may be carried out under very low shear conditions for example in a mixer having a very low tip-speed. Step (i) is typically carried out at ambient temperature and pressure, although the silicone may be subjected to a temperature in the range of from 10° C. to 50° C., or even up to 60° C. Bubbles may form during step (i). If this bubble formation phenomenon does occur during step (i), then typically the bubbles are removed by the application of a vacuum. The silicone and first surfactant are typically dosed into step (i) simultaneously, typically the first surfactant is pre-mixed with the water and is in the form of an aqueous paste when it is dosed into step (i).

Preferably step (ii) is carried out in a mixer having a tip speed in the range of from 10 $ms^{-1}$ to 50 $ms^{-1}$, preferably from 25 $ms^{-1}$ to 40 $ms^{-1}$. Suitable mixers for carrying out step (ii) include high-speed mixers such as CB Loedige™ mixers, Schugi™ mixers, Littleford™ mixers, Drais™ mixers and lab scale mixers such as Braun™ mixers. Other suitable high-speed mixers are Eirich™ mixers. Preferred high-sheer mixers include pin mixers such as a CB Loedige™ mixer, a Littleford™ mixer or a Drais™ mixer. Preferably step (iii) is carried out in a mixer having a tip speed of from 1 $ms^{-1}$ to less than 10 $ms^{-1}$, preferably from 4 $ms^{-1}$ to 7 $ms^{-1}$. Suitable mixers for carrying out step (iii) include ploughshear mixers such as a Loedige KM™. Preferably the tip speed ratio of the step (ii) mixer to the step (iii) mixer is in the range of from 2:1 to 15:1, preferably from 5:1 to 10:1. Without wishing to be bound by theory, these preferred mixer tip speeds and ratios are believed to ensure optimal process conditions to allow rapid initial mixing of the silicone, clay, anionic surfactant and water in step (ii) to ensure good homogeneity of the mixture and resultant composition, whilst also allowing a more controlled mixing step of the components of the auxiliary composition to occur in step (iii) to prevent over-mixing, such as over-agglomeration of the composition.

Preferably step (iv) is carried out in a fluid bed, such as a fluid bed dryer and/or a fluid bed cooler. The drying stage of step (iv) is typically achieved by subjecting the mixture to hot air, typically having a temperature of greater than 50° C. or even greater than 100° C. However, it may be preferred for step (iv) to be carried out at a lower temperature, such as an air inlet temperature in the range of from 10° C. to 50° C. The drying stage of step (iv) may also be achieved by subjecting the mixture to dry air, such as conditioned air. The drying stage of step (iv) is typically carried out in a fluid bed dryer. Step (iv) preferably comprises a cooling stage. During this cooling stage, the mixture is preferably subjected to cold air having a temperature of less than 15° C., preferably from 1° C. to 15° C., or from 10° C. to 15° C. This cooling stage is preferably carried out in a fluid bed cooler.

Preferably the total amount of solid material that is dosed into step (ii), such as clay and any part of the anionic surfactant, if any, that is dosed in solid form, and the total amount of liquid material that is dosed into step (ii), such as water, silicone and any part of the anionic surfactant, if any, that dosed in liquid form, is controlled such that the weight ratio of the total amount of solid material to the total amount of liquid material that is dosed into step (ii) is in the range of from 2:1 to 10:1, preferably from 3:1 to 6:1. Without wishing to be bound by theory, it is believed that these levels and ratios of solid materials and liquid materials ensure optimal mixing to prevent over-mixing, such as over-agglomeration from occurring, and ensures that the resultant auxiliary composition has a good hardness and a good flowability profile.

Preferably additional water is dosed into step (ii) and contacted with the aqueous silicone mixture, clay and the second anionic surfactant. By additional water is meant water in addition to (i.e. as well as) the water that is present in the aqueous silicone mixture (i.e. in addition to the water that is dosed in step (i)). Preferably part of the additional water that is dosed in step (ii) is in the form of an intimate mixture with the clay, this means that the part of the additional water is pre-mixed with the clay before it is dosed in step (ii): for example, the clay may be in the form of wet clay particles that also comprise water. Also, it is preferred that part of the additional water is dosed in step (ii) separately from the clay, this means that part of the additional water is not pre-mixed with the clay before it is dosed in step (ii). Most preferably part of the water dosed in step (ii) is dosed separately from any other component that is also being dosed in step (ii); in this manner preferably part of the additional water has its own individual dosing feed stream into step (ii). Without wishing to be bound by theory, it is believed that this preferred method of dosing any additional water ensures optimal control of the mixing of the composition and ensures that the composition is not over-mixed, such as over-agglomerated, and also ensures that the clay and resultant auxiliary composition have a good fabric-softening performance.

Preferably, the first anionic surfactant has a temperature in the range of from 10° C. to 50° C., preferably from 20° C. to 40° C., when it is dosed into step (i). More preferably, step (i) is carried out at an operating temperature in the range of from 10° C. to 50° C., preferably from 20° C. to 40° C. Preferably, the second anionic surfactant has a temperature in the range of from 10° C. to 50° C., preferably from 20° C. to 40° C., when it is dosed into step (ii). More preferably, step (ii) is carried out at an operating temperature in the range of from 10° C. to 50° C., preferably from 20° C. to 40° C. Preferably, the ratio of the dosing temperature of the first anionic surfactant to the dosing temperature of the second anionic surfactant is in the range of from 0.1:1 to 10:1, more preferably from 0.2:1 to 5:1 and most preferably from 0.5:1 to 2:1, the dosing temperatures being measured in ° C. Preferably the ratio of the operating temperature at which step (i) is carried out to the temperature at which step (ii) is carried out is in the range of from 0.1:1 to 10:1, more preferably from 0.2:1 to 5:1 and most preferably from 0.5:1 to 2:1, the operating temperatures being measured in ° C. Without wishing to be bound by theory, it is believed that these preferred anionic surfactant dosing temperatures and operating temperatures of steps (i) and (ii) ensure that aqueous silicone mixture and the resultant auxiliary composition have a good distribution of anionic surfactant, and ensure that the auxiliary composition is not over-mixed, such as over-agglomerated.

Optionally, fine particles such as zeolite and/or additional clay particles, typically having an average particle size in the range of from 1 micrometer to 40 micrometers or even from 1 micrometer to 10 micrometers are dosed in step (iii). Without wishing to be bound by theory, it is believed that this dusting step improves the flowability of the auxiliary composition by reducing its stickiness and controlling its particle growth.

Preferably, step (i) is carried out in an in-line static mixer or an in-line dynamic (shear) mixer, this is especially preferred for continuous processes. Alternatively, step (i) is preferably carried out in a batch mixer such as a Z-blade mixer, anchor mixer or a paddle mixer, this is especially preferred for batch processes.

Step (i) is preferably carried out at an operating temperature in the range of from 10° C. to 50° C., preferably from 20° C. to 30° C., most preferably at ambient temperature. Preferably, the temperature of the silicone is in the range of from 10° C. to 50° C. throughout the duration of steps (i), (ii) and (iii); and possibly even also for the duration of step (iv); and possibly even for the duration of the entire process of preparing the composition.

In step (i), the silicone is contacted with a first anionic surfactant and water to form an aqueous silicone mixture. The aqueous silicone mixture is in emulsified form. Preferably, the aqueous silicone mixture is in the form of an oil-in-water emulsion where the silicone forms the internal discontinous phase of the emulsion and the water forms the external continuous phase of the emulsion. Alternatively, the aqueous silicone mixture can be in the form of an water-in-oil emulsion where the water forms the internal discontinous phase of the emulsion and the silicone forms the external continuous phase of the emulsion.

Preferably, the first anionic surfactant is pre-mixed with the water before it is contacted with the silicone in step (i), typically, the first anionic surfactant is in the form of a an aqueous paste, typically having an anionic surfactant activity level in the range of from 25% to 55%, by weight of the paste.

Typically, the process comprises a size screening step, wherein particles having a particle size of greater than 1,400 micrometers are removed from the process and optionally recycled back to an earlier step in the process. Typically, these large particles are removed from the process by sieving. This size screening step typically occurs between steps (iii) and (iv) and/or after step (iv). These large particles are typically recycled back to an earlier step in the process, preferably step (ii) and/or (iii), and optionally these large particles are subjected to a grinding step before they are dosed back into an earlier process step.

The process also preferably comprises a second size screening step, wherein particles having a particle size of less than 250 micrometers are removed from the process and are typically recycled back to an earlier process step, preferably to steps (ii) and/or (iii). These small particles are removed from the process by sieving and/or elutriation. If elutriation is used, then preferably the second size screening step is carried out in a fluid bed such as the fluid bed dryer and/or cooler, for example such as a fluid bed that is typically used in step (iv) of the process.

Process for Preparing a Textile Treatment Composition for the Laundering of Fabric A textile treatment composition for the laundering of fabric can be prepared by contacting the auxiliary composition with a third anionic surfactant and optionally adjunct components. The third anionic surfactant is preferably in particulate form, typically being in the form of a spray-dried powder, an agglomerate, an extrudate, a noodle, a needle, a flake, or any combination thereof. The third anionic surfactant may be present in a particle that additionally comprises one or more adjunct components such as builder. Alternatively, the third anionic surfactant may be in the form of a liquid or a colloid/suspension.

The step of contacting the auxiliary composition with a third anionic surfactant can occur in any suitable vessel, such as a mixer or a conveyor belt. The process may also comprise the step of subjecting the textile treatment composition to a tabletting step, and/or at least partially, preferably completely, enclosing the textile treatment composition in a water-soluble film such as a film that comprises polyvinyl alcohol, so that the textile treatment composition is in the form of a tablet and/or a pouch.

Preferably, the auxiliary composition is contacted with additional clay. The additional clay is clay that is present in the textile treatment composition in addition to the clay that is present in the auxiliary composition. The additional clay may be same type or a different of clay from the clay present in the auxiliary composition. Preferably, the weight ratio of the amount of clay that is dosed into step (ii) during the process for preparing the auxiliary composition to the amount of additional clay that is contacted with the auxiliary composition is in the range of from 0.1:1 to 10:1. Without wishing to be bound by theory, it is believed that having clay processed in this manner, so that it is typically present in at least two separate particles within the textile treatment composition, enables the textile treatment composition to have an optimal fabric-softening performance and a good flowability profile.

Clay

Typically, preferred clays are fabric-softening clay such as smectite clay. Preferred smectite clays are beidellite clays, hectorite clays, laponite clays, montmorillonite clays, nontonite clays, saponite clays and mixtures thereof. Preferably, the smectite clay is a dioctahedral smectite clay, more preferably a montmorillonite clay. Dioctrahedral smectite clays typically have one of the following two general formulae:

$$Na_xAl_{2-x}Mg_xSi_4O_{10}(OH)_2 \quad \text{Formula (I)}$$

or $$Ca_xAl_{2-x}Mg_xSi_4O_{10}(OH)_2 \quad \text{Formula (II)}$$

wherein x is a number from 0.1 to 0.5, preferably from 0.2 to 0.4.

Preferred clays are low charge montmorillonite clays (also known as a sodium montmorillonite clay or Wyoming type montmorillonite clay) which have a general formula corresponding to formula (I) above. Preferred clays are also high charge montmorillonite clays (also known as a calcium montmorillonite clay or Cheto type montmorillonite clay) which have a general formula corresponding to formula (II) above. Preferred clays are supplied under the tradenames: Fulasoft 1 by Arcillas Activadas Andinas; White Bentonite STP by Fordamin; and Detercal P7 by Laviosa Chemica Mineraria SPA.

The clay may be a hectorite clay. Typical hectorite clay has the general formula:

$$[(Mg_{3-x}Li_x)Si_{4-y}Me^{III}_yO_{10}(OH_{2-z}F_z)]^{-(x+y)}((x+y)/n)M^{n+} \quad \text{Formula (III)}$$

wherein y=0 to 0.4, if y=>0 then $Me^{III}$ is Al, Fe or B, preferably y=0; $M^{n+}$ is a monovalent (n=1) or a divalent (n=2) metal ion, preferably selected from Na, K, Mg, Ca and Sr. x is a number from 0.1 to 0.5, preferably from 0.2 to 0.4, more preferably from 0.25 to 0.35. z is a number from 0 to 2. The value of (x+y) is the layer charge of the clay, preferably the value of (x+y) is in the range of from 0.1 to 0.5, preferably from 0.2 to 0.4, more preferably from 0.25 to 0.35. A preferred hectorite clay is that supplied by Rheox under the tradename Bentone HC. Other preferred hectorite clays for use herein are those hectorite clays supplied by CSM Materials under the tradename Hectorite U and Hectorite R, respectively.

The clay may also be selected from the group consisting of: allophane clays; chlorite clays, preferred chlorite clays are amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydroxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

The clay may also be a light coloured crystalline clay mineral, preferably having a reflectance of at least 60, more preferably at least 70, or at least 80 at a wavelength of 460 nm. Preferred light coloured crystalline clay minerals are china clays, halloysite clays, dioctahedral clays such as kaolinite, trioctahedral clays such as antigorite and amesite, smectite and hormite clays such as bentonite (montmorillonite), beidilite, nontronite, hectorite, attapulgite, pimelite, mica, muscovite and vermiculite clays, as well as pyrophyllite/talc, willemseite and minnesotaite clays. Preferred light coloured crystalline clay minerals are described in GB2357523A and WO01/44425.

Preferred clays have a cationic exchange capacity of at least 70 meq/100 g. The cationic exchange capacity of clays can be measured using the method described in Grimshaw, The Chemistry and Physics of Clays, Interscience Publishers, Inc., pp. 264-265 (1971).

Preferably, the clay has a weight average primary particle size, typically of greater than 20 micrometers, preferably more than 23 micrometers, preferably more than 25 micrometers, or preferably from 21 micrometers to 60 micrometers, more preferably from 22 micrometers to 50 micrometers, more preferably from 23 micrometers to 40 micrometers, more preferably from 24 micrometers to 30 micrometers, more preferably from 25 micrometers to 28 micrometers. Clays having these preferred weight average primary particle sizes provide a further improved fabric-softening benefit. The method for determining the weight average particle size of the clay is described in more detail hereinafter.

Method for Determining the Weight Average Primary Particle Size of the Clay

The weight average primary particle size of the clay is typically determined using the following method: 12 g clay is placed in a glass beaker containing 250 ml distilled water and vigorously stirred for 5 minutes to form a clay suspension. The clay is not sonicated, or microfluidised in a high pressure microfluidizer processor, but is added to said beaker of water in an unprocessed form (i.e. in its raw form). 1 ml clay suspension is added to the reservoir volume of an Accusizer 780 single-particle optical sizer (SPOS) using a micropipette. The clay suspension that is added to the reservoir volume of said Accusizer 780 SPOS is diluted in more distilled water to form a diluted clay suspension; this dilution occurs in the reservoir volume of said Accusizer 780 SPOS and is an automated process that is controlled by said Accusizer 780 SPOS, which determines the optimum concentration of said diluted clay suspension for determining the weight average particle size of the clay particles in the diluted clay suspension. The diluted clay suspension is left in the reservoir volume of said Accusizer 780 SPOS for 3 minutes. The clay suspension is vigorously stirred for the whole period of time that it is in the reservoir volume of said Accusizer 780 SPOS. The diluted clay suspension is then sucked through the sensors of said Accusizer 780 SPOS; this is an automated process that is controlled by said Accusizer 780 SPOS, which determines the optimum flow rate of the diluted clay suspension through the sensors for determining the weight average particle size of the clay particles in the diluted clay suspension. All of the steps of this method are carried out at a temperature of 20° C. This method is carried out in triplicate and the mean of these results determined.

Silicone

The silicone is preferably a fabric-softening silicone. The silicone typically has the general formula:

Formula (IV)

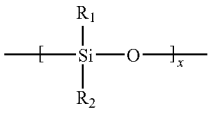

wherein, each $R_1$ and $R_2$ in each repeating unit, —(Si($R_1$)($R_2$)O)—, are independently selected from branched or unbranched, substituted or unsubstituted $C_1$-$C_{10}$ alkyl or alkenyl, substituted or unsubstituted phenyl, or units of —[—$R_1R_2$Si—O—]—; x is a number from 50 to 300,000, preferably from 100 to 100,000, more preferably from 200 to 50,000; wherein, the substituted alkyl, alkenyl or phenyl are typically substituted with halogen, amino, hydroxyl groups, quaternary ammonium groups, polyalkoxy groups, carboxyl groups, or nitro groups; and wherein the polymer is terminated by a hydroxyl group, hydrogen or —$SiR_3$, wherein, $R_3$ is hydroxyl, hydrogen, methyl or a functional group.

Suitable silicones include: amino-silicones, such as those described in EP150872, WO92/01773 and U.S. Pat. No. 4,800,026; quaternary-silicones, such as those described in U.S. Pat. No. 4,448,810 and EP459821; high-viscosity silicones, such as those described in WO00/71806 and WO00/71807; modified polydimethylsiloxane; functionalized polydimethyl siloxane such as those described in U.S. Pat. No. 5,668,102. Preferably, the silicone is a polydimethylsiloxane.

The silicone may preferably be a silicone mixture of two or more different types of silicone. Preferred silicone mixtures are those comprising: a high-viscosity silicone and a low viscosity silicone; a functionalised silicone and a non-functionalised silicone; or a non-charged silicone polymer and a cationic silicone polymer.

The silicone typically has a viscosity, of from 5,000 cP to 5,000,000 cP, or from greater than 10,000 cP to 1,000,000 cP, or from 10,000 cP to 600,000 cP, more preferably from 50,000 cP to 400,000 cP, and more preferably from 80,000 cP to 200,000 cP when measured at a shear rate of 20 $s^{-1}$ and at ambient conditions (20° C. and 1 atmosphere). The silicone is typically in a liquid or liquefiable form, especially when admixed with the clay. Typically, the silicone is a polymeric silicone comprising more than 3, preferably more than 5 or even more than 10 siloxane monomer units.

Aqueous Silicone Mixture

The aqueous silicone mixture may comprise at least 80%, by weight of the aqueous silicone mixture, of silicone, preferably polydimethylsiloxane (PDMS). The aqueous silicone mixture may comprise at least 2.5%, by weight of the aqueous silicone mixture, of a first anionic surfactant, preferably sodium linear alkyl benzene sulphonate. The weight ratio of silicone to first anionic surfactant present in the aqueous silicone mixture may be in the range of from 5:1 to 35:1, preferably from 10:1 to 30:1, or from 15:1 to 25:1. The first anionic surfactant is preferably in the form of an aqueous paste (along with at least part of the water that is dosed in step (i) of the process) having an anionic surfactant activity (such as linear alkyl benzene sulphonate activity) in the range of from 25% to 55% by weight of the paste.

The aqueous silicone mixture is in the form of an emulsion. The aqueous silicone mixture can be an oil-in-water emulsion or a water-in-oil emulsion. The aqueous silicone mixture is preferably in the form of an oil-in-water emulsion with the water forming at least part, and preferably all, of the external continuous phase, and the silicone forming at least part, and preferably all, of the internal discontinuous phase. The aqueous silicone mixture typically has a volume average primary droplet size of from 0.1 micrometers to 5,000 micrometers, preferably from 0.1 micrometers to 50 micrometers, and most preferably from 0.1 micrometers to 5 micrometers, or from 1 micrometer to 20 micrometers. The volume average primary particle size is typically measured using a Coulter Multisizer™ or by the method described in more detail below.

The aqueous silicone mixture typically has a viscosity of from 500 cps to 70,000 cps, or from 5,000 cps to 20,000 cps, or even from 3,000 cps to 10,000 cps.

Method for Determining the Volume Average Droplet Size of the Aqueous Silicone Mixture:

The volume average droplet size of the aqueous silicone mixture is typically determined by the following method: An aqueous silicone mixture is applied to a microscope slide with the cover slip being gently applied. The aqueous silicone mixture is observed at 400× and 1,000× magnification under the microscope and the average droplet size of the aqueous silicone mixture is calculated by comparison with a standard stage micrometer.

First, Second and Third Anionic Surfactant

The first, second and third anionic surfactant can be the same type of anionic surfactant or can be different types of anionic surfactant and are each separately and independently selected from the group consisting of: linear or branched, substituted or unsubstituted $C_{8-18}$ alkyl sulphates; linear or branched, substituted or unsubstituted $C_{8-18}$ alkyl ethoxylated sulphates having an average degree of ethoxylation of from 1 to 20; linear or branched, substituted or unsubstituted $C_{8-18}$ linear alkylbenzene sulphonates; linear or branched, substituted or unsubstituted $C_{12-18}$ alkyl carboxylic acids; Most preferred are anionic surfactants selected from the group consisting of: linear or branched, substituted or unsubstituted $C_{8-18}$ alkyl sulphates; linear or branched, substituted or unsubstituted $C_{8-18}$ linear alkylbenzene sulphonates; and mixtures thereof.

Adjunct Components

The auxiliary composition and/or the textile treatment composition may optionally comprise one or more adjunct components. These adjunct components are typically selected from the group consisting of: other surfactants such as non-ionic surfactants, cationic surfactants and zwitterionic surfactants; builders such as zeolite and polymeric co-builders such as polymeric carboxylates; bleach such as percarbonate, typically in combination with bleach activators, bleach boosters and/or bleach catalysts; chelants; enzymes such as proteases, lipases and amylases; anti-redeposition polymers; soil-release polymers; polymeric soil-dispersing and/or soil-suspending agents; dye-transfer inhibitors; fabric-integrity agents; fluorescent whitening agents; suds suppressors; additional fabric-softeners such as cationic quaternary ammonium fabric-softening agents; flocculants; and combinations thereof.

Preferred flocculants include polymers comprising monomer units selected from the group consisting of ethylene oxide, acrylamide, acrylic acid and mixtures thereof. Preferably the flocculating aid is a polyethyleneoxide. Typically the flocculating aid has a molecular weight of at least 100,000 Da, preferably from 150,000 Da to 5,000,000 Da and most preferably from 200,000 Da to 700,000 Da.

Auxiliary Composition

The auxiliary composition is suitable for use in the laundering and/or treatment of fabrics and typically either forms part of a textile treatment composition such as a fully formulated laundry detergent composition or a laundry additive composition that is suitable for addition to a fully formulated laundry detergent composition or is suitable for use to complement a fully formulated laundry detergent composition. A suitable laundry additive composition is a rinse-added fabric-softening composition. Preferably, the auxiliary composition forms part of a fully formulated laundry detergent composition. The auxiliary composition is suitable per se for the treatment and/or laundering of fabric.

The auxiliary composition comprises an anionic surfactant, clay and a silicone and optionally adjunct components.

Preferably, the auxiliary composition comprises from above 0% to 10%, preferably from 0.001%, or from 0.01% or from 0.1% or even from 0.2% or even 0.3%, and to 8% or to 6%, or to 4% or to 2% or to 1% or to 0.8%, by weight of the auxiliary composition, of a first anionic surfactant. Preferably, the auxiliary composition comprises from above 0% to 20%, preferably from 0.1%, or from 0.5% or from 1% or even from 2%, and to 15% or to 10%, or to 8% or to 6%, by weight of the auxiliary composition, of a second anionic surfactant. The weight ratio of the second anionic surfactant to the first anionic surfactant that are present in the auxiliary composition is preferably in the range of from 0.001:1 or from 0.01:1, or from 0.1:1, or from 1:1, or from 2:1, or from 5:1, and to 10,000:1, or to 5,000:1, or to 1,000:1, or to 750:1, or to 500:1, or to 250:1, or to 100:1, or to 75:1, or to 50:1, or to 25:1, or to 15:1, or to 10:1. Without wishing to be bound by theory, these preferred levels and ratios of anionic surfactant are believed to ensure optimal hardness of the particulate auxiliary composition which in turn ensures good flowability, whilst at the same time also ensuring good fabric-softness performance.

Preferably the auxiliary composition comprises from 10%, or from 25%, or from 50%, or from 75%, and to 95%, or to 90%, by weight of the auxiliary composition, of clay. Preferably the auxiliary composition comprises from 1%, or from 2%, or from 3%, or from 4%, or from 5%, and to 25%, or to 20%, or to 15%, or to 13%, or to 12%, or to 10%, by weight of the auxiliary composition, of silicone. Preferably the weight ratio of the clay to the silicone that are present in the auxiliary composition is in the range of from 1:1, or from 2:1, or from 3:1, or from 4:1, or from 5:1, or from 6:1, or from 7:1, and to 100:1, or to 50:1, or to 25:1, or to 20:1, or to 15:1. Without wishing to be bound by theory, these preferred levels and ratios of clay and silicone are believed to ensure the optimal fabric-softening performance profile whilst also ensuring good flowability of the auxiliary composition.

The auxiliary composition is in particulate form, typically being in the form of a free-flowing powder, such as an agglomerate, an extrudate, a spray-dried powder, a needle, a noodle, or any combination thereof. It may be preferred that the auxiliary composition is subjected to a tabletting process step and forms part of a textile treatment composition that is in the form of a tablet. The auxiliary composition may also be at least partially, preferably completely, enclosed in a water-soluble film, such as a film comprising polyvinyl alcohol, and form a pouch. Most preferably, the auxiliary composition is in the form of an agglomerate. Most preferably, the auxiliary composition is contacted to adjunct components and forms part of a textile treatment composition for the laundering of fabric, such as a granular laundry detergent composition preferably in free-flowing particulate form.

Textile Treatment Composition for the Laundering of Fabric

The textile treatment composition comprises the auxiliary composition, and preferably is a laundry detergent composition that comprises the auxiliary composition and typically at least one additional detersive surfactant, optionally a flocculating aid, optionally a builder and optionally a bleach. The textile treatment composition optionally comprises one or more other adjunct components.

The textile treatment composition is preferably in particulate form, preferably in free-flowing particulate form, although the textile treatment composition may be in any liquid or solid form. The textile treatment composition in solid form can be in the form of an agglomerate, granule, flake, extrudate, bar, tablet or any combination thereof. The solid composition can be made by methods such as dry-mixing, agglomerating, compaction, spray drying, pan-granulation, spheronization or any combination thereof. The solid composition preferably has a bulk density of from 300 g/l to 1,500 g/l, preferably from 500 g/l to 1,000 g/l.

The textile treatment composition may also be in the form of a liquid, gel, paste, dispersion, preferably a colloidal dispersion or any combination thereof. The liquid compositions typically have a viscosity of from 500 cps to 3,000 cps, when measured at a shear rate of 20 $s^{-1}$ at ambient conditions (20° C. and 1 atmosphere), and typically have a density of from 800 g/l to 1300 g/l. If the composition is in the form of a dispersion, then it will typically have a volume average particle size of from 1 micrometer to 5,000 micrometers, preferably from 1 micrometer to 50 micrometers. The particles that form the dispersion are usually the clay and, if present, the silicone. Typically, a Coulter Multisizer is used to measure the volume average particle size of a dispersion.

The textile treatment composition may in unit dose form, including not only tablets, but also unit dose pouches wherein the textile treatment composition is at least partially enclosed, preferably completely enclosed, by a film such as a polyvinyl alcohol film.

The textile treatment composition is typically capable of both cleaning and softening fabric during a laundering process. Typically, the textile treatment composition is a laundry detergent composition that is formulated for use in an automatic washing machine, although it can also be formulated for hand-washing use.

The following adjunct components and levels thereof, when incorporated into a laundry detergent composition of the present invention, further improve the fabric-softening performance and fabric-cleaning performance of the laundry detergent composition: at least 10%, by weight of the laundry detergent composition, of alkyl benzene sulphonate detersive surfactant; at least 0.5%, or at least 1%, or even at least 2%, by weight of the laundry detergent composition, of a cationic quaternary ammonium detersive surfactant; at least 1%, by weight of the laundry detergent composition, of an alkoxylated alkyl sulphate detersive surfactant, preferably ethoxylated alkyl sulphate detersive surfactant; less than 12% or even less than 6%, or even 0%, by weight of the laundry detergent composition, of a zeolite builder; and any combination thereof. Preferably the laundry detergent composition comprises at least 6%, or even at least 8%, or even at least 12%, or even at least 18%, by weight of the laundry detergent composition, of the auxiliary composition. Preferably the laundry detergent composition comprises at least 0.3%, by weight of the laundry detergent composition, of a flocculating aid. The weight ratio of clay to flocculant in the laundry detergent composition is preferably in the range of from 10:1 to 200:1, preferably from 14:1 to 160:1 more preferably from 20:1 to 100:1 and more preferably from 50:1 to 80:1.

EXAMPLES

Example 1

A Process for Preparing a Silicone Emulsion by Batch Mixing 10.0 g of 45 w/w % aqueous $C_{11-13}$ alkylbenzene sulphonate (LAS) paste and 10.0 g water are added to a beaker and gently mixed, to avoid foaming, until a homogeneous paste is formed. 80.0 g of polydimethylsiloxane (silicone) having a viscosity of 100,000 cP at ambient temperature, is then added to the beaker on top of the LAS/water paste. The silicone, LAS and water are mixed thoroughly by hand using a flat knife for 2 minutes to form an emulsion.

Example 2

A Process for Preparing a Silicone Emulsion by Batch Mixing

A silicone emulsion suitable for use in the present invention is prepared according to the method of example 1, but the emulsion comprises 15.0 g of 30 w/w % aqueous $C_{11-13}$ alkylbenzene sulphonate (LAS) paste, 5.0 g water and 80.0 g of polydimethylsiloxane (silicone).

Example 3

A Process for Preparing a Silicone Emulsion by Batch Mixing

A silicone emulsion suitable for use in the present invention is prepared according to the method of example 1, but the emulsion comprises 9.1 g of 30 w/w % aqueous $C_{11-13}$ alkylbenzene sulphonate (LAS) paste and 90.9 g of polydimethylsiloxane (silicone).

Example 4

A Process for Preparing a Silicone Emulsion by Batch Mixing 20.0 kg of 45 w/w % aqueous $C_{11-13}$ alkylbenzene sulphonate (LAS) paste and 20.0 kg water are added to a batch mixing vessel with a large diameter slow moving agitator (10-60 rpm), and gently mixed, to avoid foaming, until a homogeneous paste is formed. 160.0 kg of polydimethylsiloxane (silicone) having a viscosity of 100,000 cP at ambient temperature, is then added slowly to the vessel on top of the paste while agitating. The silicone, LAS and water are mixed thoroughly for 1-2 hours to form an emulsion.

Example 5

A Process for Preparing a Silicone Emulsion Via Continuous Mixing Process

Polydimethylsiloxane (silicone) having a viscosity of 100,000 cP, 45 w/w % aqueous $C_{11-13}$ alkylbenzene sulphonate (LAS) paste and water are dosed via suitable pumps and flowmeters into a dynamic mixer (such as an IKA DR5 or similar) at the following rates, silicone 290 kg/h, LAS paste 35 kg/h, water 35 kg/h. Material temperatures are between 20-30 degrees centigrade. The mixing head is rotated at a tip speed of 23 m/s. The material exiting the mixer is a homogeneous emulsion.

Example 6

A Process for Making a Clay/Silicone Agglomerate 536 g of bentonite clay is added to a Braun mixer. 67 g of the emulsion of any of examples 1-5 is added to the Braun mixer, and the ingredients in the mixer are mixed for 10 seconds at 1,100 rpm (speed setting 8). 53 g of 45 w/w % aqueous $C_{11-13}$ alkylbenzene sulphonate (LAS) paste is then poured into the mixer over a period of 20-30 seconds while mixing continues. The speed of the Braun mixer is then increased to 2,000 rpm (speed setting 14) and 44 g water is added slowly to the Braun mixer. The mixer is kept at 2,000 rpm for 30 seconds so that wet agglomerates are formed. The wet agglomerates are transferred to a fluid bed dried and dried for 4 minutes at 140° C. to form dry agglomerates. The dry agglomerates are sieved to remove agglomerates having a particle size greater than 1,400 micrometers and agglomerates having a particle size of less than 250 micrometers.

Example 7

A Process for Making a Clay/Silicone Agglomerate Via Continuous Mixing Process

Bentonite clay is dosed via suitable feeder (e.g. a Brabender Loss In Weight feeder, LIW) at a rate of 575 kg/h into a high speed mixer (e.g. a CB 30 Lodige) running at a speed of 1600-1800 rpm. Emulsion prepared according to any of examples 1-5 is dosed into the mixer at a rate of 71 kg/h, along with 56 kg/h of 45 w/w % aqueous $C_{11-13}$ alkylbenzene sulphonate (LAS) paste and 48 kg/h water. The wet particles that form exit the high speed mixer and feed into a low shear mixer (e.g. a KM 600 Lodige) running at a speed of 140 rpm. The mixing action and residence time grow the particles into agglomerates with a particle size range of 150-2000 micrometers. The agglomerates from the low shear mixer enter a fluid bed with inlet air temperature of 145 degrees centigrade to dry off the excess moisture, before passing into a second fluid bed with inlet air temperature of 10 degrees centigrade to cool down the agglomerates. Fine particles of 150-300 micrometer particle size, equivalent to 25% of the total raw material feed rate are elutriated from the fluid beds and recycled back to the high speed mixer. The product from the second fluid bed is then sieved to remove particles greater than 1180 micrometers, which are recycled back to the first fluid bed after passing through a grinder. The final agglomerates from the end of the process have a 5 w/w % water content, and a particle size range between 200-1400 micrometers.

Example 8

A Process for Making a Clay Agglomerate 547.3 g of bentonite clay is added to a Braun mixer. 25.5 g of glycerine is added by pouring into the Braun mixer over a period of 10-20 seconds, while mixing at 1,100 rpm (speed setting 8). This is followed by 16.9 g of molten paraffin wax (at 70° C.) poured into the mixer over a period of 10-20 seconds while mixing continues. The speed of the Braun mixer is then increased to 2,000 rpm (speed setting 14) and 110 g water is added slowly to the Braun mixer. The mixer is kept at 2,000 rpm for 30 seconds so that wet agglomerates are formed. The wet agglomerates are transferred to a fluid bed dried and dried for 4 minutes at 140° C. to form dry agglomerates. The dry agglomerates are sieved to remove agglomerates having a particle size greater than 1,400 micrometers and agglomerates having a particle size of less than 250 micrometers.

Example 9

A Process for Making a Clay Agglomerate Via Continuous Mixing Process

Bentonite clay is dosed via suitable feeder (e.g. a Brabender Loss In Weight feeder, LIW) at a rate of 7036 kg/h into a high speed mixer (e.g. a CB 75 Lodige) running at a speed of 900-1060 rpm. Glycerine is dosed into the mixer at a rate of 327 kg/h, along with 217 kg/h of paraffin wax at a temperature of 70° C. and 1,419 kg/h water. The wet particles exit the high speed mixer and feed into a low shear mixer (e.g. a KM 4200 Lodige) running at a speed of 80-100 rpm. The mixing action and residence time grow the particles into agglomerates with particle size range of 150-2000 micrometers. The agglomerates from the low shear mixer enter a fluid bed with inlet air temperature of 145-155 degrees centigrade to dry off the excess moisture, before passing into a second fluid bed with inlet air temperature of 5-15 degrees centigrade to cool down the agglomerates. Fines particles of less than 300 micrometer particle size, equivalent to 25% of the total raw material feed rate are elutriated from the fluid beds and recycled back to the high speed mixer. The product from the second fluid bed is then sieved to remove particles greater than 1180 micrometers, which are recycled back to the first fluid bed after passing through a grinder. The final agglomerates from the end of the process have a 3-5 w/w % water content and a particle size range between 200-1400 micrometers.

Example 10

A Process for Making an Anionic Agglomerate

A premix of 78 w/w % aqueous $C_{11-13}$ alkylbenzene sulphonate (LAS) paste and sodium silicate powder is made by mixing the two materials together in a Kenwood orbital blender at maximum speed for 90 seconds. 296 g of zeolite and 75 g of sodium carbonate are added to a Braun mixer. 329 g of the LAS/silicate premix, which is preheated to 50-60° C., is added onto the top of the powders to the Braun mixer with a knife. The Braun mixer is then run at 2,000 rpm (speed setting 14) for a period of 1-2 minutes, or until wet agglomerates form. The wet agglomerates are transferred to a fluid bed dried and dried for 4 minutes at 130° C. to form dry agglomerates. The dry agglomerates are sieved to remove agglomerates having a particle size greater than 1,400 micrometers and agglomerates having a particle size of less than 250 micrometers. The final particle composition comprises: 40.0 wt % $C_{11-13}$ alkylbenzene sulphonate detersive surfactant; 37.6 wt % zeolite; 0.9 wt % sodium silicate; 12.0 wt % sodium carbonate; 9.5 wt % miscellaneous/water.

Example 11

A Process for Making an Anionic Agglomerate Via Continuous Mixing Process

Zeolite is dosed via suitable feeder (e.g. a Brabender Loss In Weight feeder, LIW) at a rate of 3792 kg/h into a high speed mixer (e.g. a CB 75 Lodige) running at a speed of 800-1000 rpm. Sodium carbonate powder is also added simultaneously to the high speed mixer at a rate of 969 kg/h. A premix of 78 w/w % aqueous $C_{11-13}$ alkylbenzene sulphonate (LAS) paste and sodium silicate powder, formed by intimately mixing the two components under shear, is dosed into the mixer at a rate of 4239 kg/h, where it is blended into the powders to form wet particles. The wet particles exit the high speed mixer and feed into a low shear mixer (e.g. a KM 4200 Lodige) running at a speed of 80-100 rpm. The mixing action and residence time grow the particles into agglomerates with particle size range of 150-2000 micrometers. The agglomerates from the low shear mixer enter a fluid bed with an inlet air temperature of 125-135 degrees centigrade to dry off the excess moisture, before passing into a second fluid bed with an inlet air temperature of 5-15 degrees centigrade to cool down the agglomerates. Fines particles of less than 300 micrometer particle size, equivalent to ~25% of the total raw material feed rate are elutriated from the fluid beds and recycled back to the high speed mixer. The product from the second fluid bed is then sieved to remove particles greater than 1180 micrometers, which are recycled back to the first fluid bed (dryer) after passing through a grinder. The final agglomerates from the end of the process have a 5-6 w/w % water content, and a particle size range between 200-1400 micrometers. Final particle composition comprises: 40.0 wt % $C_{11-13}$ alkylbenzene sulphonate detersive surfactant; 37.6 wt % zeolite; 0.9 wt % sodium silicate; 12.0 wt % sodium carbonate; 9.5 wt % miscellaneous/water.

Example 12

A Laundry Detergent Spray Dried Particle

A detergent particle is produced by mixing the liquid and solid components of the formulation with water to form a viscous slurry. The slurry is fed under high pressure through nozzles to give atomisation in a spray drying tower, where the atomised droplets encounter a hot air stream. Water is rapidly evaporated from the droplets giving porous granules which are collected at the base of the tower. The granules are then cooled via an airlift, and screened to remove coarse lumps. A spray dried laundry detergent particle composition suitable for use in the present invention comprises: 12.2 wt % $C_{11-13}$ alkylbenzene sulphonate detersive surfactant; 0.4 wt % polyethylene oxide having a weight average molecular weight of 300,000 Da; 1.6 wt % $C_{12-14}$ alkyl, di-methyl, ethoxy quaternary ammonium detersive surfactant; 11 wt % zeolite A; 20.3 wt % sodium carbonate; 2.1 wt % sodium maleic/acrylic copolymer; 1 wt % soap; 1.3 wt % sodium toluene sulphonate; 0.1 wt % ethylenediamine-N'N-disuccinic acid, (S,S) isomer in the form of a sodium salt; 0.3 wt % 1,1-hydroxyethane diphosphonic acid; 0.6 wt % magnesium sulphate; 42 wt % sulphate; 7.1 wt % miscellaneous/water.

Example 13

A Laundry Detergent Composition

A laundry detergent composition suitable for use in the present invention comprises: 9.8 wt % clay/silicone agglomerates according to any of examples 6-7; 6.9 wt % anionic surfactant agglomerates according to any of examples 10-11; 59.1 wt % spray dried detergent particle according to example 12; 4.0 wt % clay agglomerates according to any of examples 8-9; 1 wt % alkyl sulphate detersive surfactant condensed with an average of 7 moles of ethylene oxide; 5.1 wt % sodium carbonate; 1.4 wt % tetraacetylyethylenediamine; 7.6 wt % percarbonate; 1.0 wt % perfume; 4.1 wt % miscellaneous/water.

The invention claimed is:

1. A process for preparing a textile treatment auxiliary composition in particulate form, wherein the composition comprises anionic surfactant, clay and silicone, and wherein the process comprises the steps of:

(i) contacting the silicone with water and 0.001 to 8% wt of a first anionic surfactant, to form an aqueous silicone mixture in emulsified form;

(ii) contacting the aqueous silicone mixture with clay, to form a mixture of clay and silicone;

(iii) further mixing the mixture of clay and silicone;

(iv) contacting the mixture of clay and silicone with 1 to 10% wt of a second anionic surfactant and optionally additional water;

(v) further mixing the mixture of clay and silicone and second anionic surfactant to form a wet agglomerate;

(vi) removing the wet agglomerates having a size greater than 1400 micrometers by sieving;

(vii) drying and optionally cooling the wet agglomerate; and (viii) removing the dried agglomerates having a size less than 250 micrometers by sieving or elutriation, wherein the first anionic surfactant is different from the second anionic surfactant.

2. A process according to claim 1, wherein step (ii) is carried out in a mixer having a tip speed in the range of from 10 $ms^{-1}$ to 50 $ms^{-1}$ and step (iii) is carried out in a mixer having a tip speed in the range of from 1 $ms^{-1}$ to less than 10 $ms^{-1}$.

3. A process according to claim 1, wherein the weight ratio of the total amount of solid material to the total amount of liquid material dosed into step (ii) is in the range of from 2:1 to 10:1.

4. A process according to claim 1, wherein additional water is contacted with the aqueous silicone mixture in step (ii), and wherein part of the additional water that is dosed into step (ii) is dosed in the form of an intimate mixture with the clay, and wherein at least part of the additional water that is dosed into step (ii) is dosed separately from the clay.

5. A process according to claim 1, wherein the first anionic surfactant has a temperature of from 10° C. to 50° C. when it dosed into step (i), and wherein the second anionic surfactant has a temperature of from 10° C. to 50° C. when it is dosed into step (ii), wherein the temperature ratio of the dosing temperature of the first anionic surfactant to the dosing temperature of the second anionic surfactant is in the range of from 0.5:1 to 2:1.

6. A process according to claim 1, wherein the composition comprises:

(i) from 50% to 95%, by weight of the auxiliary composition, of clay; and (ii) from 4% to 13%, by weight of the auxiliary composition, of silicone;

and wherein the weight ratio of clay to silicone is in the range of from 4:1 to 20:1.

7. A process according to claim 1, wherein the composition is in free-flowing particulate form.

8. A process according to claim 1, wherein the mixing of step (v) is at a higher speed setting than the mixing of step (iii).

9. A process for preparing a composition for the laundering or treatment of fabric, comprising the step of contacting an auxiliary composition obtained by a process according to claim 1 with a third anionic surfactant and optionally adjunct components.

10. A process for preparing a textile treatment auxiliary composition in particulate form, wherein the composition comprises anionic surfactant, clay and silicone, and wherein the process comprises the steps of:

(i) contacting the silicone with water and 0.001 to 8% wt of a first anionic surfactant, to form an aqueous silicone mixture in emulsified form;

(ii) contacting the aqueous silicone mixture with clay, 1 to 10% wt of a second anionic surfactant and optionally additional water to form a mixture of clay and silicone;

(iii) further mixing the mixture of clay and silicone;

(iv) removing the mixture of clay and silicone having a size greater than 1400 micrometers by sieving;

(v) drying and optionally cooling the mixture formed in step (iii) to form said auxiliary composition;

(vi) removing the dried auxiliary particulate having a size less than 250 micrometers by sieving or elutriation; and (vii) further contacting said auxiliary composition with an additional clay, wherein said weight ratio of clay in step (ii) to additional clay is in the range of from 0.1:1 to 10:1 and wherein the first anionic surfactant is different from the second anionic surfactant.

* * * * *

UNITED STATES PATENT AND TRADEMARK OFFICE

CERTIFICATE OF CORRECTION

PATENT NO. : 7,638,478 B2
APPLICATION NO. : 11/499998
DATED : December 29, 2009
INVENTOR(S) : Dodd et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 550 days.

Signed and Sealed this

Ninth Day of November, 2010

David J. Kappos

David J. Kappos
*Director of the United States Patent and Trademark Office*